United States Patent [19]

Gore

[11] 4,365,861

[45] Dec. 28, 1982

[54] WIRE TERMINAL

[75] Inventor: William C. Gore, Elgin, Ill.

[73] Assignee: Illinois Tool Works Inc., Chicago, Ill.

[21] Appl. No.: 221,072

[22] Filed: Dec. 29, 1980

[51] Int. Cl.[3] ..... H01R 9/10

[52] U.S. Cl. ..... 339/202; 339/249 B

[58] Field of Search ..... 339/201, 202, 244 B, 339/249 B, 255 B, 272 B

[56] References Cited

U.S. PATENT DOCUMENTS

| | | | |
|---|---|---|---|
| 822,492 | 6/1906 | Turner | 339/202 |
| 1,660,807 | 2/1928 | Norgen | 339/202 |
| 1,677,783 | 7/1928 | Kearney | 339/202 |
| 2,362,200 | 11/1944 | Gray | 339/202 |
| 2,597,037 | 5/1952 | Runde | 85/1 X |
| 2,635,312 | 4/1953 | McCullough | 151/31 X |
| 2,740,100 | 3/1956 | Broverman | 339/202 |
| 2,934,593 | 4/1960 | Kollinger | 339/202 |
| 3,349,365 | 10/1967 | Dozier | 339/255 B |
| 3,552,257 | 1/1971 | Tanabe | 339/272 B |
| 3,923,406 | 12/1975 | Iritz | 403/43 |

*Primary Examiner*—Joseph H. McGlynn

*Attorney, Agent, or Firm*—Thomas W. Buckman

[57] ABSTRACT

An electrical connector having a split bolt and a cap. The slot in the bolt extends axially into the bolt to a point displaced from a lateral flange. When a wire is passed through the slot, the cap is threaded onto the bolt deflecting the wire into a non-linear path and clamping it in at least two places.

6 Claims, 5 Drawing Figures

WIRE TERMINAL

The present invention is directed to an electrical connector or wire terminal, the features and advantages of which will be fully appreciated after a reading of the following specification when taken in conjunction with the accompanying drawings.

DETAILED DESCRIPTION OF THE PREFERRED EMBODIMENTS

Figure 1:
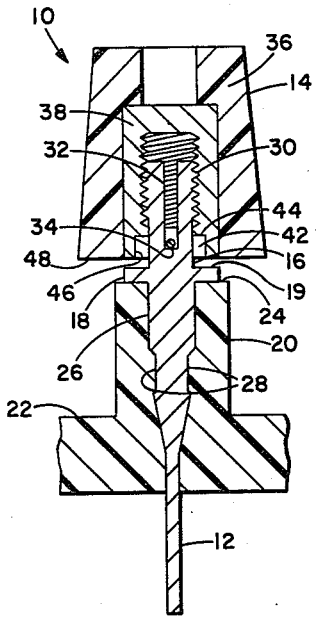
FIG. 1 is a lateral cross-section of one embodiment of the electrical connector of the present invention as viewed along the axis of the wire.

The electrical connector or wire terminal of the present invention is shown generally at 10. This connector is comprised of a connector bolt 12 and a connector cap 14. Bolt 12 has an axially extending member 16 and a laterally extending flange 18. Upper surface 19 of flange 18 forms a first reference surface. Typically, the connector bolt will be mounted in a terminal post 20 of circuit board 22 with the flange 18 seated against the upper surface 24 of post 20. The lower or mounting portion 26 of bolt 12 may be configured with recesses 28 to provide retention in post 20. Board 22 including post 20 is preferably of a plastic material which will cold flow into recesses 28.

Axially extending member 16 has a threaded portion 30 with a longitudinal slot 32 extending axially into it. The depth of the slot 32 is such that the slot bottom 34 is in a plane that is axially displaced from that of flange 18, the slot bottom defining a second reference surface. The upper surface of flange 19 and slot bottom 34 are interconnected by axially extending walls 35. Slot 32 is wide enough to accomodate the largest diameter wire with which it is intended the electrical connector 10 is to be used.

Cap 14 of the first embodiment has a first outer component 36 which is preferably made of plastic or other insulative material with a serrated exterior to facilitate gripping. Inner component 38 is preferably metallic having an internal thread 40 which will mate with threaded portion 30 of bolt 12. This thread defines a first maximum inner dimension of the cap. A recess 42 is formed in one end of the cap and defines a second maximum inner dimension greater than said first dimension. Recess 42 defines a shoulder 44 at its point of maximum extention into cap 14 and an annular surface 46 extending toward the end 48 of the cap. An opening 50 is provided in the other end of the cap to provide access to component 38. This opening 50 permits the connection to be tested.

Figure 2:
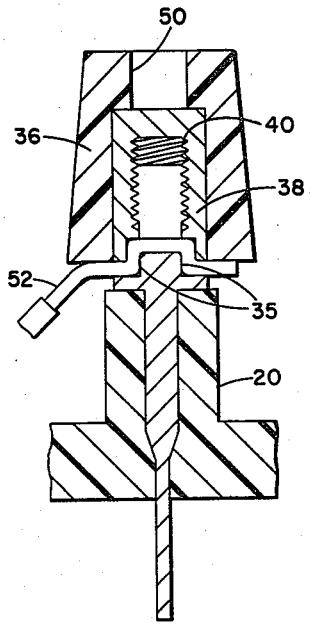
FIG. 2 is a lateral cross-section of the connector shown in FIG. 1 as seen transverse to the axis of the wire.

As best shown in FIG. 2, a stripped wire end 52 is inserted into slot 32 in bolt 12. Cap 14 is placed over bolt 12 and threads 40 of component 38 engaged with threads 30 of the bolt. As the cap is tightened, end 48 engages portions of wire 52 deflecting them downward toward the flange 18. The wire is forced downward and held firmly between slot bottom 34 and shoulder 44. The deflection of wire 52 into a non-linear path brings the wire at least partially into contact axially extending walls 35 and further insures solid electrical contact. Depending on tolerances and the wire diameter, wire 52 may be clamped between additional surfaces. In this embodiment, those surfaces can include walls 35 and annular internal surface 46 and/or the first reference surface 19 and the end 48 of cap 14.

It is a feature of the electrical connector of the present invention that wire 52 can be securely clamped to connector bolt 12 without mashing the wire or squeezing out some of the wire strands as may occur with some connectors. However, the clamping action will cause some movement of the materials in flange 18, component 38 and wire 52, which will provide a prevailing torque. Even though the amount of material movement may be so small as to be almost imperceptible, the prevailing torque is sufficient to prevent undesired loosening of the cap.

Figure 3:
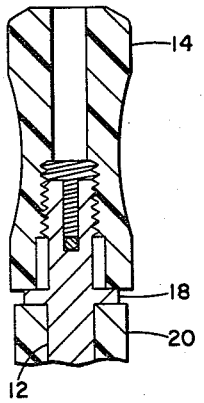
FIG. 3 is a lateral cross-section similar to FIG. 1 of a second embodiment of the present invention.
Figure 5:
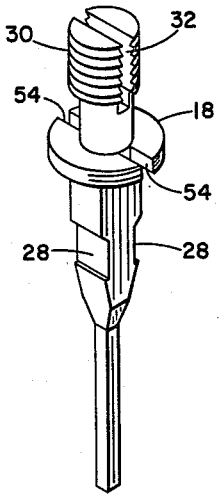
FIG. 5 is a perspective of the connector bolt of the second embodiment.
Figure 4:
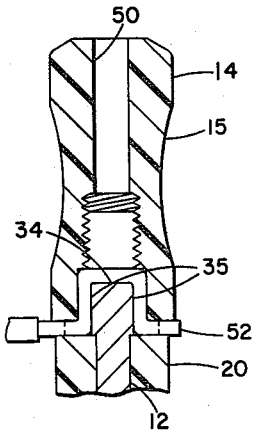
FIG. 4 is a lateral cross-section of the FIG. 3 embodiment as seen in a direction transverse to the wire.

A second embodiment is depicted in FIGS. 3–5. The only difference in the connector bolt 10 from that of the previous embodiment is that flange 18 has two opposed radial slots 54. Depending upon the configuration of terminal post 20, this will permit the wire 52 to enter and exit at angles to the horizontal as may be required. Further, these slots 54 keep the wire on opposite sides of bolt 12 preventing wrapping which could cause the wire to pull loose from its connection at the opposite end.

Cap 14 of this embodiment is a one-piece plastic member with threads 40 being molded or cut directly in the plastic. Opening 50, again, provides access for testing the connection, the meter leads being brought into contact with the end of bolt 12 rather than with component 38 as in the previous embodiment. The cap 14 is recessed on the sides at 15 to provide better finger gripping.

Both embodiments of the electrical connector of the present invention provide a simple but effective terminal which clamps the wire, without mashing it, in at least two places. The wire is deformed without stretching, as well as clamped, increasing the surface contact between the wire and connector to improve electrical contact.

Various changes, alterations and modifications will become apparent to a person of ordinary skill following a reading of the foregoing specification. Accordingly, it is intended that all such changes, alterations and modifications as come with the scope of the appended claims be considered part of the present invention.

I claim:

1. An electrical connector comprising a bolt and a cap said bolt comprising an axially extending member having a first maximum external lateral dimension, a laterally extending flange having a second maximum external lateral dimension, said flange forming a first reference surface in a first plane said member having a longitudinal slot extending axially thereinto, the bottom of said slot forming a second reference surface in a second plane axially removed from said first plane, said first and second reference surfaces being interconnected by generally axially extending walls, said member having an external thread on a portion thereof; said cap having an internal thread on a portion thereof which forms a first maximum internal lateral dimension and will mate with the external thread on said bolt, a recess at one end of said cap defining a second maximum internal dimension which is greater than said first maximum internal lateral dimension, said recess further defining a shoulder at the point of maximum extent into the cap and an annular internal surface extending toward said one end, such that a wire may be inserted in said slot and the cap threadingly engaged with said bolt so the wire will be deflected into a non-linear path at least partially engaging a portion of axially extending walls with a portion of the wire effectively clamped between said second reference surface on the bolt and the shoulder of the cap recess.

2. The electrical connector of claim 1 wherein the bolt and cap cooperate to clamp the wire between additional surfaces.

3. The electrical connector of claim 2 wherein said additional surfaces are the axially extending walls of the bolt and the annular internal surface of the cap.

4. The electrical connector of claim 2 wherein said additional surfaces are an end surface of the cap and said first reference surface of said bolt.

5. The electrical connector of claim 2 wherein said flange has laterally extending, wire-receiving slots and said additional surfaces are an end surface of the cap and a surface of a terminal post in which the bolt is mounted.

6. The electrical connector of claim 2, 3 or 4 wherein the cap is of a plastic material which will deflect when clampingly engaged in the region of engagement between the wire and one of its clamping surfaces to create a prevailing torque.

* * * * *